US009162457B1

(12) United States Patent
Li et al.

(10) Patent No.: US 9,162,457 B1
(45) Date of Patent: Oct. 20, 2015

(54) INK LEVEL SENSOR FORMED WITH AN ARRAY OF SELF-SENSING PIEZOELECTRIC TRANSDUCERS

(71) Applicant: Xerox Corporation, Norwalk, CT (US)

(72) Inventors: Faming Li, Solon, OH (US); Jing Zhou, Pittsford, NY (US); Xuejin Wen, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/568,523

(22) Filed: Dec. 12, 2014

(51) Int. Cl.
*B41J 2/045* (2006.01)
*B41J 2/14* (2006.01)

(52) U.S. Cl.
CPC ..... *B41J 2/14233* (2013.01)

(58) Field of Classification Search
CPC .... B41J 2/14233; B41J 2/14274; B41J 2/161; B41J 2/1623; B41J 2/1646; B41J 2002/14419; B41J 2002/14491
USPC ..... 347/68, 70, 71
See application file for complete search history.

(56) References Cited

U.S. PATENT DOCUMENTS 4,703,652 A 11/1987 Itoh et al.
5,184,332 A * 2/1993 Butler ..... 367/162
5,188,286 A 2/1993 Pence, IV
5,578,994 A 11/1996 Cherek et al.
6,142,015 A 11/2000 Getman et al.
6,925,869 B2 8/2005 Senibi et al.
8,091,579 B2 1/2012 Sintes et al.
8,646,860 B1 2/2014 Jones et al.
2002/0063751 A1 * 5/2002 Aizawa et al. ..... 347/46
2014/0022292 A1 * 1/2014 Jones et al. ..... 347/7

* cited by examiner

*Primary Examiner* — Manish S Shah
*Assistant Examiner* — Roger W Pisha, II
(74) *Attorney, Agent, or Firm* — Maginot Moore & Beck LLP

(57) ABSTRACT

A fluid level sensor is configured for identifying a fluid level in a small volume reservoir, such as a fluid reservoir in an ejector head. The reservoir includes a plurality of vertically arranged chambers. A plurality of piezoelectric transducers is distributed over the chambers in a one-to-one correspondence. At least one electrical conductor is electrically connected to each piezoelectric transducer in the plurality of piezoelectric transducers to enable each piezoelectric sensor to receive an electrical signal to a portion of a wall of the chamber to produce an acoustical wave in the chamber and to transmit an electrical signal from each piezoelectric transducer in response to a fluctuating pressure on each piezoelectric transducer produced by the acoustical wave in the chamber.

8 Claims, 4 Drawing Sheets

INK LEVEL SENSOR FORMED WITH AN ARRAY OF SELF-SENSING PIEZOELECTRIC TRANSDUCERS

TECHNICAL FIELD

This disclosure relates generally to fluid level sensing and, in particular, to fluid level sensing in reservoirs containing materials to be ejected in three-dimensional object printing.

BACKGROUND

In general, printers include at least one printhead or ejector head that ejects drops of liquid ink in two dimensional printers and drops of material in three-dimensional object printing onto a surface. In some cases, monitoring of the volume or the head height of the ink or materials stored for ejection is important. Accurate monitoring of the head height is especially important where the head height of a stored fluid affects the mechanism or system that draws or uses the fluid. For example, restricting the head height range within an ink reservoir and precisely controlling the replenishment to an on-board ink reservoir of a printhead are often needed to prevent overfill-caused dripping of ink from the printhead jet orifices and to prevent the introduction of air if the fluid level is depleted below tolerable levels. Air can cause ink to foam and render a printhead inoperative.

Currently available fluid sensing systems suffer from a number of drawbacks. For instance, applications in which small reservoirs or holding tanks are needed to store a fluid may not offer the space or fluid height required to accommodate known fluid sensing systems, such as float-based systems. Also, many "sense and fill" systems suffer from significant hysteresis problems in that these systems tend to respond late or overfill before flow is stopped. Moreover, fluid sensing systems that sense fluid materials by detecting a resistance change upon attaining a liquid level are dependent on consistent material properties, which may change over the life of the mechanism or system that uses the fluid. For example, the properties of a fluid may deteriorate over time due to age degradation, or the fluid may be replaced with a fluid having different properties. This problem is more frequently encountered in three-dimensional object printing because these printers typically store a wider range of materials than inkjet printers. Therefore, improvements to sensing systems that enable fluid sensing in small reservoirs and that can detect fluids with varying properties are desired.

SUMMARY

A reservoir includes a sensor that enables measurement of a height of fluid in small volume reservoirs. The reservoir includes a reservoir having a housing with a volume for containing a fluid, a plurality of chambers, each chamber having a wall that encloses a volume that is connected pneumatically with the volume within the housing, the chambers being arranged vertically within the volume, a plurality of piezoelectric transducers, each chamber having one of the piezoelectric transducers mounted to the wall of the chamber in a one-to-one correspondence, and at least one electrical conductor electrically connected to each piezoelectric transducer in the plurality of piezoelectric transducers to enable each piezoelectric sensor to receive an electrical signal to bend a portion of the wall of the chamber on which the piezoelectric transducer is located to produce an acoustical wave in the chamber and to transmit an electrical signal from each piezoelectric transducer in response to a fluctuating pressure on each piezoelectric transducer produced by the acoustical wave.

A printhead incorporates the reservoir and fluid level sensor to improve the measurement accuracy of ink head height within the printhead. The printhead includes a reservoir having a housing with a volume for containing a fluid, the reservoir is pneumatically connected to the apertures in the nozzle plate, a plurality of apertures in the housing that communicate with the volume within the housing, a plurality of chambers, each chamber having a wall that encloses a volume that is connected pneumatically with the volume within the housing, the chambers being arranged vertically within the volume, a plurality of piezoelectric transducers, each chamber having one of the piezoelectric transducers mounted to the wall of the chamber in a one-to-one correspondence, and at least one electrical conductor electrically connected to each piezoelectric transducer in the plurality of piezoelectric transducers to enable each piezoelectric sensor to receive an electrical signal to bend a portion of the wall of the chamber on which the piezoelectric transducer is located to produce an acoustical wave in the chamber and to transmit an electrical signal from each piezoelectric transducer in response to a fluctuating pressure on each piezoelectric transducer produced by the acoustical wave.

A printhead has been configured with at least two of the fluid sensors to enable a controller to detect the orientation of a printhead and the fluid level within the printhead. The printhead includes a reservoir having a housing with a volume for containing a fluid, the reservoir is pneumatically connected to the apertures in the nozzle plate, a plurality of apertures in the housing that communicate with the volume within the housing, at least two fluid level sensors arranged orthogonally within the volume of the housing, each fluid level sensor having: a plurality of chambers, each chamber having a wall that encloses a volume that is connected pneumatically with the volume within the housing, the chambers being arranged vertically within the volume, a plurality of piezoelectric transducers, each chamber having one of the piezoelectric transducers mounted to the wall of the chamber in a one-to-one correspondence, and at least one electrical conductor electrically connected to each piezoelectric transducer in the plurality of piezoelectric transducers to enable each piezoelectric sensor to receive an electrical signal to bend a portion of the wall of the chamber on which the piezoelectric transducer is located to produce an acoustical wave in the chamber and to transmit an electrical signal from each piezoelectric transducer in response to a fluctuating pressure on each piezoelectric transducer produced by the acoustical wave.

BRIEF DESCRIPTION OF THE DRAWINGS

The foregoing aspects and other features of a reservoir with a fluid sensor configured to measure a height of a fluid are explained in the following description, taken in connection with the accompanying drawings.

DETAILED DESCRIPTION

Figure 1:
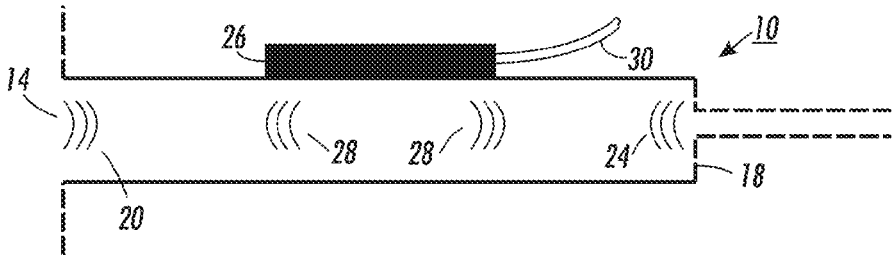
FIG. 1 is a cross-sectional view of an acoustical resonance chamber useful for detecting ink in the chamber

For a general understanding of the present embodiments, reference is made to the drawings. In the drawings, like reference numerals have been used throughout to designate like elements. FIG. 1 depicts an acoustical resonance chamber configuration useful for detecting fluid level in a reservoir. The chamber 10 can be any shape and need not be symmetrical. The chamber 10 has a large aspect ratio as the length is significantly greater than the width of the chamber. Each end of the chamber 10 has an opening. Opening 14 is an open end, which borders the reservoir in which a fluid is stored. Opening 18 is a closed end, which borders a fluid path that is less wide than the chamber 10. A traveling wave 22 is reflected at each end of the chamber 10. At the open end 14, the interface of the fluid in the chamber and the fluid in the reservoir reflects a significant portion of the traveling wave 20 back into the chamber. At closed end 18, the structure of the narrowing opening reflects the wave 24 back into the chamber. A piezoelectric transducer 26 is mounted to one wall of the chamber 10. The wall to which the transducer is mounted is flexible, like a diaphragm in a printhead, to enable a change in a dimension of the transducer 26 induced by a driving signal delivered by a conductor 30 to produce a traveling acoustical wave 28 in the chamber 10. The transducer is located outside of the chamber 10 to insulate the transducer electrically from the fluid in the chamber. While the chamber 10 is shown having one end open and the other end closed, the chamber can be formed with two closed ends or two open ends as long as an acoustical impedance mismatch is present at each end to enable the traveling wave produced by the transducer to be reflected at each end.

The natural frequency of chamber 10 corresponds to the round trip travel time of a pressure wave bouncing between the ends 14 and 18. The size of the chamber is no more than 5 mm, and in some embodiments it is less than 500 μm. The more viscous the fluid in the reservoir, the smaller the chamber size is to minimize energy dissipation by the viscous fluid. The oscillation of the wave is eventually dampened by the viscosity of the fluid and the chamber structure since the walls of the chamber are not fully elastic.

Figure 2:
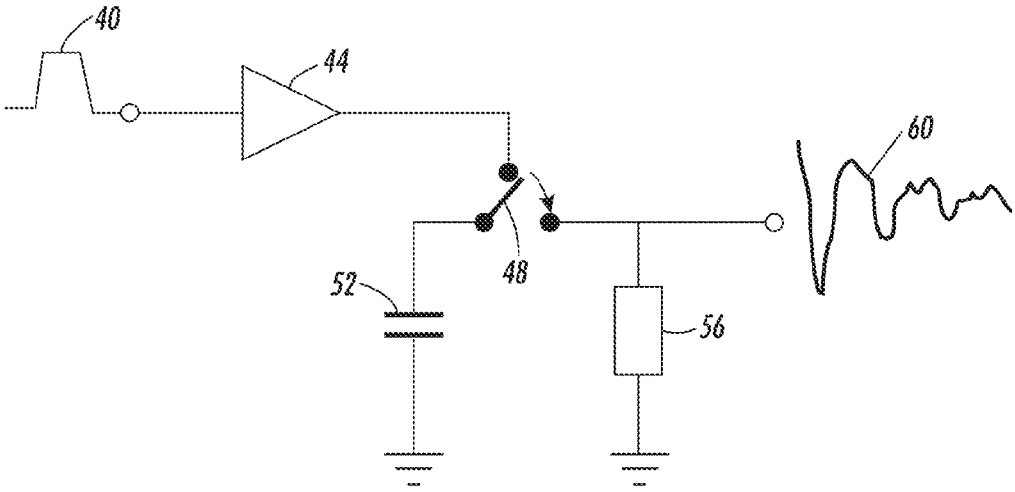
FIG. 2 is an electrical schematic diagram of a circuit that represents the ability of the transducer in FIG. 1 to produce an acoustical wave in the acoustical resonance chamber and sense the resulting wave.

FIG. 2 is an electrical schematic diagram of a circuit that can be used to produce a traveling wave in the chamber 10 and to sense the effect of the wave as it is reflected back and forth in the chamber. A controller, such as the ones shown in FIG. 3A and FIG. 4A, can generate a driving signal 40 that is delivered by operational amplifier 44 to the transducer 52 through the switch 48 when the switch is connected to the output of the amplifier 44. As noted above, this signal causes the transducer 52 to deflect and bend the wall of the chamber to which it is mounted. The controller can then operate the switch 48 to connect the transducer 52 electrically to the resistor 56. Electrical charge is generated by the transducer 52 as the transducer responds to the force of the traveling wave vibrating the wall to which the transducer is mounted as the wave travels between the two ends. This charge is discharged through the resistor 56 and the charge signal decays as the traveling wave dissipates and the force on the wall reduces. The pressure in the chamber can be measured by monitoring the charge or voltage on the transducer induced by the force of the wave vibrating the wall to which the transducer is mounted.

The signal 60 is proportional to the total pressure on the transducer surface. The circuit in FIG. 2 is for illustration purposes only as many different circuit designs can be used to measure the charge on the piezoelectric transducer 52 and derive the pressure in the chamber. The signal 60 generated by the transducer 52 is monitored by a controller to measure the time series curve of the pressure acting on the wall to which the transducer is mounted. The resonant frequency of this signal can be obtained by spectral analysis of the curve. For a given chamber, the resonant frequency is a function of the speed of sound in the fluid. Because the speed of sound in any fluid is much higher than the speed of sound in air, the presence of any fluid in chamber is easily detected if the measured resonant frequency is higher than the resonant frequency of sound in air.

Figures 3A, 3B:
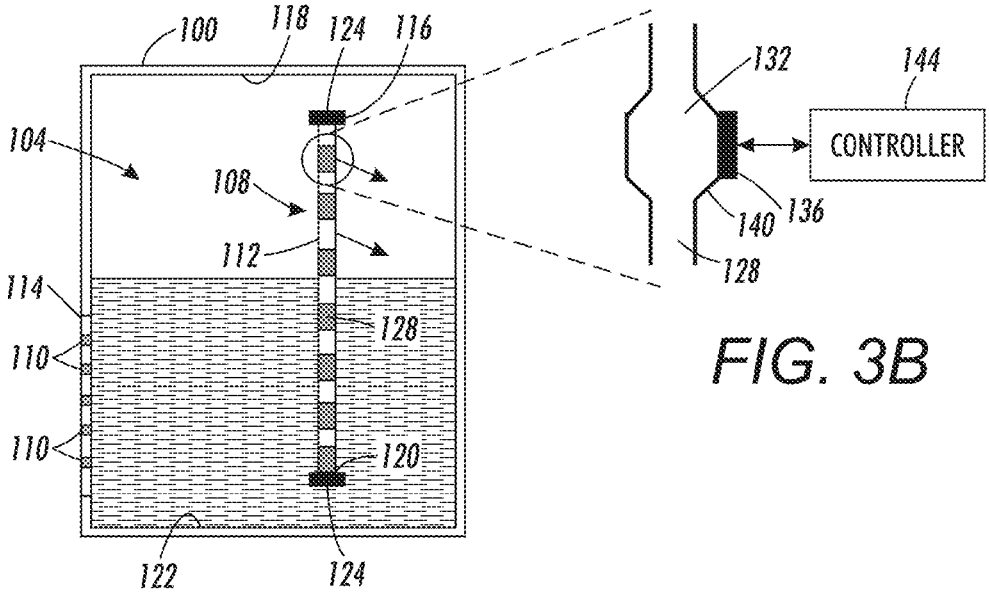
FIG. 3A is a cross-sectional view of an ink reservoir in a printhead that incorporates a piezoelectric fluid sensor for measuring the height of ink within the reservoir.
FIG. 3B is a cross-sectional view of a single acoustical resonance chamber in the fluid sensor of FIG. 3A.

FIG. 3A depicts a cross-sectional view of a printhead 100 having a reservoir 104 in which a piezoelectric level sensor 108 is positioned within the volume of the reservoir. The reservoir 104 has a ceiling 118 and a floor 122. The fluid stored within the reservoir can be supplied by any known fluid transport technique. For example, a pressure differential can be generated by a pump or the like to urge fluid from a source, such as an external tank, through a conduit to the reservoir 104. The fluid stored within the reservoir 104 is pneumatically coupled to the apertures 110 in the wall 114 to enable ejection of the fluid. In the embodiment shown in FIG. 3A, the fluid is ejected from the side of the reservoir. In other embodiments, the apertures 110 are located in the floor 122 and the fluid is ejected downwardly from the reservoir. The structure for the apertures 110 and the ejectors to which they are pneumatically connected is greatly simplified in the figures.

In one embodiment, the piezoelectric sensor 108 includes a vertically oriented housing 112 having an upper opening 116 and a lower opening 120. Each opening has a filter 124 positioned across the opening to enable ink to enter and exit the housing 112 at openings 116 and 120, respectively. A channel 128 extends through the housing 112 between openings 116 and 120. As shown in the exploded view of FIG. 3B, the channel 128 includes a plurality of acoustical resonance chambers 132 that are positioned end-to-end to form the channel 128. Each chamber 132 includes an electromechanical transducer 136 that is attached to a wall 140, which operates as a flexible diaphragm. The electromechanical transducer can be a piezoelectric transducer that includes a piezo element disposed, for example, between electrodes that enable firing signals to be received from a controller 144 over an electrical conductor as noted above. Actuation of the piezoelectric transducer with a driving signal causes the transducer to bend the wall 140 and produce a traveling wave in the resonance chamber. The electrical conductor also enables the controller 144 to receive an electrical signal from the transducer 136 that corresponds to a response of the transducer to the force of the traveling wave acting on the wall to which the transducer is mounted.

As noted previously, when the chamber is filled with fluid, the resonant frequency of the signal produced by the transducer is at a frequency that is significantly higher than the resonant frequency of the signal when the chamber is filled with air. Thus, the frequency of the response indicates whether the chamber is filled or empty. Consequently, the controller can activate the transducers sequentially or simultaneously and detect the responses of the transducers individually. By identifying the transducer that generates a fluid filled frequency and the adjacent transducer that generates an air filled frequency, the controller is able to determine where the fluid level is. If one sensor chamber is partially filled with fluid, the fluid level is detected with reference to the resonant frequency being between the resonant frequency for a fluid filled chamber and the resonant frequency for an air filled chamber. Appropriate action can then be taken, such as operating a pump to urge more ink into the reservoir when one of the transducers near the lower end of the channel 128 indicates the chamber is air filled. The structure of the sensor 108 in FIG. 3A provides a significant advantage over other known sensors because it does not need to be configured to detect the resonant frequency of a single fluid. With the speed of sound in air being much lower than the speed of sound in any fluid, a frequency threshold can be chosen for a low viscosity fluid. As long as the measured resonant frequency is greater than that frequency threshold, fluid is detected in the chamber since higher viscosity fluids are associated with higher resonant frequencies. Thus, sensor 108 can be used for a wide range of fluid viscosities and is especially useful in three-dimensional object printing systems where various build materials, support materials and coating materials are used. For example, if the frequency threshold is selected to be twice the resonant frequency of the speed of sound in air, the sensor is capable of detecting a wide range of fluid levels with an appropriate buffer to guard against inadvertently identifying a resonant frequency in fluid as being a resonant frequency of an air filled chamber.

Figure 4A:
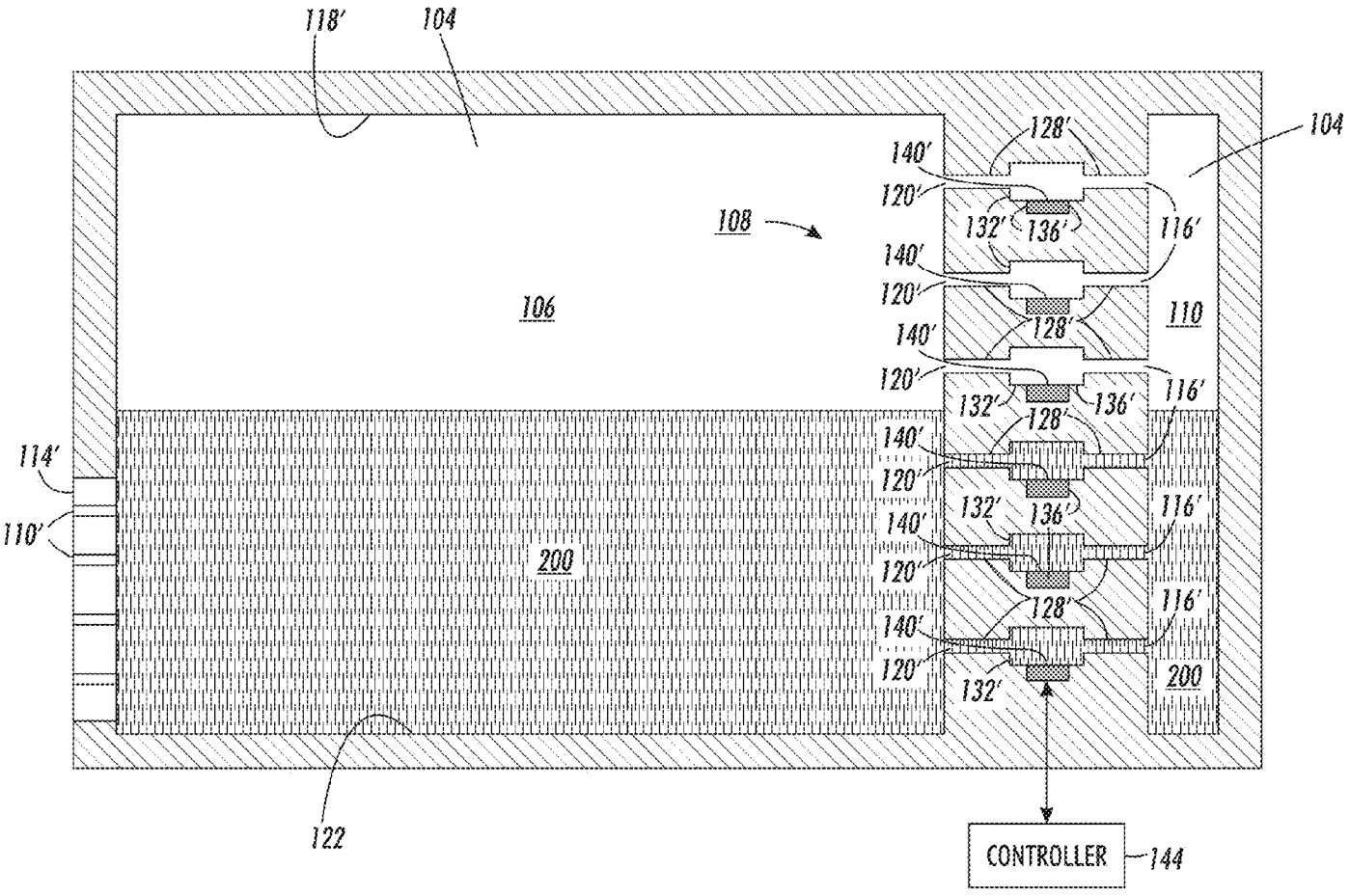
FIG. 4A is a cross-sectional view of an ink reservoir in a printhead that incorporates an alternative embodiment of the piezoelectric fluid sensor for measuring the height of ink within the reservoir.
Figure 4B:
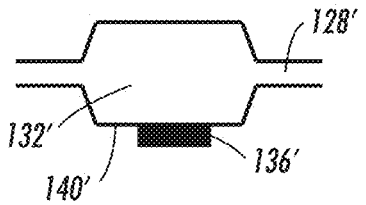
FIG. 4B is a cross-sectional view of a single acoustical resonance chamber in the fluid sensor of FIG. 4A.

Using the same reference numbers for like elements, a second embodiment of an ejector head 100' having an ink level sensor 108' is shown in FIG. 4A. The figure depicts a cross-sectional view of an ink reservoir 104' having a plurality of chambers 132', each of which communicates via a channel 128' with two different portions 106 and 110 of the reservoir 104'. Each of these reservoir portions has a ceiling 118' and a floor 122'. The ink 200 stored within the reservoir 104' is pneumatically coupled to the apertures 110' in the wall 114'. The chambers 132' and the channels 128' are oriented in a horizontal direction and each channel 128' has an opening 116' and an opening 120'. Each chamber 132' includes an electromechanical transducer 136' that is attached to a flexible wall 140', which operates as a diaphragm. The electromechanical transducer can be a piezoelectric transducer that includes a piezo element disposed, for example, between electrodes that enable driving signals to be received from a controller 144' over an electrical conductor. Actuation of the piezoelectric transducer with a driving signal causes the transducer to bend the wall 140' and produce a traveling wave in the chamber. The electrical conductor also enables the controller 144 to receive an electrical signal from the transducer 136' that corresponds to a response of the transducer to the force of the traveling wave acting on the flexible wall 140' after the driving signal has been removed.

As noted previously, when the chamber is filled with fluid, the resonant frequency of the signal produced by the transducer is at a frequency that is significantly higher than the resonant frequency of the signal when the chamber is filled with air. Thus, the frequency of the response indicates whether the chamber is filled or empty. Consequently, the controller can activate the transducers sequentially or simultaneously and detect the responses of the transducers individually. By identifying the transducer that generates a fluid filled frequency and the adjacent transducer that generates an air filled frequency, the controller is able to determine where the fluid level is. If one sensor chamber is partially filled with fluid, the fluid level is detected with reference to the resonant frequency being between the resonant frequency for a fluid filled chamber and the resonant frequency for an air filled chamber. Appropriate action can then be taken, such as operating a pump to urge more ink into the reservoir when one of the transducers near the lower end of the channel 128' indicates the chamber is air filled. The structure of the sensor 108' in FIG. 4A provides the advantage of the sensor 108 in FIG. 3A since it too can be configured for a wide range of fluid viscosities by selecting an appropriate frequency threshold as noted above. Again, this type of fluid level sensor is especially useful in three-dimensional object printing systems where various build materials, support materials and coating materials are used.

Figure 5:
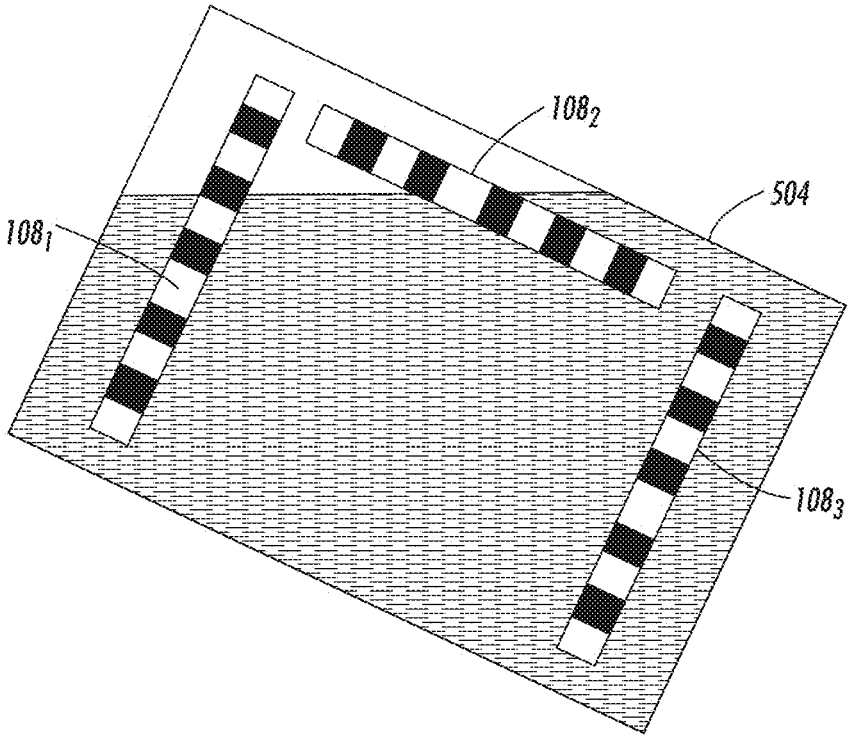
FIG. 5 shows a reservoir having three fluid sensors to enable fluid level detection in various orientations of the reservoir.

The sensors 108 can be positioned within an ejector head 504 as shown in FIG. 5 to enable the ejector head to be mounted in a system in either a side ejecting position as shown in FIG. 3A and FIG. 4A, in a downwardly ejecting orientation or a rotated orientation as shown in FIG. 5. At least two of the sensors are arranged to be orthogonal to one another, such as sensor $\mathbf{108}_2$ is to $\mathbf{108}_1$ and $\mathbf{108}_3$. This arrangement of the sensors 108 enables at least one sensor to be aligned with a rising and falling ink level if the printhead is oriented in a side ejecting or a downwardly ejecting orientation. Additionally, a controller is able to detect the fluid level in a printhead oriented as shown in FIG. 5 by identifying the two or more chambers corresponding to the top level and the line between them. Thereafter, the controller can determine the fluid level with reference to the detected orientation. Consequently, this sensor arrangement is not dependent on the ejector head being installed in a known orientation. Instead, the controller can determine the ejector orientation and monitor the sensors with reference to the detected orientation.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printhead comprising:

a reservoir having a housing with a volume for containing a fluid;

a plurality of apertures in a nozzle plate of the housing that are pneumatically connected to the volume within the housing;

a plurality of chambers, each chamber having a wall that encloses a volume that is connected pneumatically with the volume within the housing, the chambers being arranged vertically within the volume, each chamber having a first end and a second end, the first end being a closed end that communicates with a first passageway that is narrower than the chamber and the second end being a closed end that communicates with a second passageway that is narrower than the chamber;

a plurality of piezoelectric transducers, each chamber having one of the piezoelectric transducers mounted to the wall of the chamber in a one-to-one correspondence; and at least one electrical conductor electrically connected to each piezoelectric transducer in the plurality of piezoelectric transducers to enable each piezoelectric sensor to receive an electrical signal to bend a portion of the wall of the chamber on which the piezoelectric transducer is located to produce an acoustical wave in the chamber and to transmit an electrical signal from each piezoelectric transducer in response to a fluctuating pressure on each piezoelectric transducer produced by the acoustical wave.

2. The printhead of claim 1, each chamber having a pair of openings configured to enable fluid to flow through the chamber, each chamber being in fluid communication between a first portion of the volume within the housing and a second portion of the volume within the housing and the chambers being arranged vertically in the volume to enable one chamber to be proximate a ceiling for the volume within the housing and to enable another chamber to be proximate a floor for the volume within the housing and the remaining chambers being interposed between the one chamber and the other chamber.

3. A printhead comprising:

a reservoir having a housing with a volume for containing a fluid;

a plurality of apertures in a nozzle plate of the housing that are pneumatically connected to the volume within the housing;

a plurality of chambers, each chamber having a wall that encloses a volume that is connected pneumatically with the volume within the housing, the chambers being arranged vertically within the volume;

a plurality of piezoelectric transducers, each chamber having one of the piezoelectric transducers mounted to the wall of the chamber in a one-to-one correspondence;

at least one electrical conductor electrically connected to each piezoelectric transducer in the plurality of piezoelectric transducers to enable each piezoelectric sensor to receive an electrical signal to bend a portion of the wall of the chamber on which the piezoelectric transducer is located to produce an acoustical wave in the chamber and to transmit an electrical signal from each piezoelectric transducer in response to a fluctuating pressure on each piezoelectric transducer produced by the acoustical wave; and a controller operatively connected to each at least one electrical conductor, the controller being figured to transmit the electrical signal that causes the piezoelectric transducer to bend the portion of the wall of the chamber, to receive the electrical signal from each piezoelectric transducer in response to the fluctuating pressure, and to identify a fluid level within the volume of the housing with reference to the electrical signals received from the piezoelectric transducers.

4. The printhead of claim 3, each chamber having a first end and a second end, the first end being an open end that communicates directly with the volume in the housing and the second end being a closed end that communicates with a passageway that is narrower than the chamber.

5. The printhead of claim 3, each chamber having a first end and a second end, the first end being an open end that communicates directly with the volume in the housing and the second end being an open end that communicates directly with the volume in the housing.

6. A printhead comprising:

a reservoir having a housing with a volume for containing a fluid;

a plurality of apertures in a nozzle plate of the housing that are pneumatically connected to the volume within the housing;

a plurality of chambers, each chamber having a wall that encloses a volume that is connected pneumatically with the volume within the housing, the chambers being arranged vertically within the volume, each chamber having a pair of openings configured to enable fluid to flow through the chamber, the chambers being coupled together to form a single channel that enables fluid to enter the single channel at one end and exit the single channel at another end;

a plurality of piezoelectric transducers, each chamber having one of the piezoelectric transducers mounted to the wall of the chamber in a one-to-one correspondence; and at least one electrical conductor electrically connected to each piezoelectric transducer in the plurality of piezoelectric transducers to enable each piezoelectric sensor to receive an electrical signal to bend a portion of the wall of the chamber on which the piezoelectric transducer is located to produce an acoustical wave in the chamber and to transmit an electrical signal from each piezoelectric transducer in response to a fluctuating pressure on each piezoelectric transducer produced by the acoustical wave.

7. The printhead of claim 6, the chambers being oriented vertically in the reservoir to enable the one end of the single channel to be proximate a ceiling for the volume within the housing and to enable the other end of the single channel to be proximate a floor for the volume within the housing.

8. The printhead of claim 7 further comprising:

a first filter positioned to cover the one end of the single channel; and a second filter positioned to cover the other end of the single channel.

* * * * *